US007237305B2

(12) United States Patent
Newman et al.

(10) Patent No.: US 7,237,305 B2
(45) Date of Patent: Jul. 3, 2007

(54) EXTENSION POLE WITH TOOL LOCK AND RETRACTION DAMPENER

(75) Inventors: Dere Newman, Greenwood, MO (US); William Daniel Richardson, Greenwood, MO (US)

(73) Assignee: Specialty Products of Greenwood, Missouri, Inc., Greenwood, MO (US)

( * ) Notice: Subject to any disclaimer, the term of this patent is extended or adjusted under 35 U.S.C. 154(b) by 71 days.

(21) Appl. No.: 10/709,856

(22) Filed: Jun. 2, 2004

(65) Prior Publication Data

US 2005/0279520 A1 Dec. 22, 2005

(51) Int. Cl.
*B25G 1/04* (2006.01)

(52) U.S. Cl. ..... 16/429; 16/427; 15/144.4

(58) Field of Classification Search ..... 16/429, 16/405, 66, 427; 81/177.2, 53.1, 53.11, 53.12; 294/19.1, 19.2, 24; 403/109.1, 377; 15/144.4
See application file for complete search history.

(56) References Cited

U.S. PATENT DOCUMENTS 3,380,097 A * 4/1968 Pharris ..... 15/145
5,123,768 A 6/1992 Franklin
5,161,278 A * 11/1992 Tomm ..... 15/159.1
5,220,707 A 6/1993 Newman, Sr. et al.
5,316,264 A 5/1994 Newman, Sr. et al.
D351,015 S 9/1994 Caceres et al.
D354,554 S 1/1995 Newman, Sr. et al.
5,460,458 A 10/1995 Caceres
5,692,856 A 12/1997 Newman, Jr. et al.
5,743,577 A 4/1998 Newman, Jr. et al.
5,876,147 A * 3/1999 Longo ..... 403/109.5
5,983,455 A * 11/1999 Polzin et al. ..... 16/429
D452,777 S 1/2002 Newman et al.
6,453,777 B1 9/2002 Newman et al.
6,530,124 B2 3/2003 Newman et al.
6,701,578 B1 * 3/2004 Lu ..... 16/429
2005/0129456 A1 * 6/2005 Van Der Sluis ..... 403/109.1

* cited by examiner

*Primary Examiner*—Chuck Y. Mah
*Assistant Examiner*—Michael J. Kyle
(74) *Attorney, Agent, or Firm*—Hovey Williams LLP

(57) ABSTRACT

An improved extension pole (10) is provided having an outer tubular pole section (12) and an inner pole section (14) telescopically and reciprocally received within the section (12). The outer section (12) has a shock-absorbing component (38) mounted adjacent the base (20) thereof, which safely absorbs shocks incident to unrestrained fall of the inner pole section (14). The pole (10) also includes a fixture mounting element (74) with an associated locking member (88), the latter being threadably mounted and movable against the base of a fixture such as a light bulb changer (18), in order to securely mount the fixture in place on the pole (10). An improved, cam-type locking mechanism (16) is also provided which gives a short-throw twist operation through less than about a 45° arc.

13 Claims, 4 Drawing Sheets

EXTENSION POLE WITH TOOL LOCK AND RETRACTION DAMPENER

CROSS REFERENCE TO RELATED APPLICATIONS

This application is being filed contemporaneously with application for U.S. Design Pat. Ser. No. 29/206,848, entitled EXTENSION POLE, which is hereby incorporated by reference herein.

BACKGROUND OF THE INVENTION

1. Field of the Invention

The present invention is broadly concerned with multiple-section extension poles of the type commonly used for light bulb changing or other work in high or otherwise unaccessible locations. More particularly, the invention pertains to extension poles of this character including inner and outer, telescopically interfitted pole sections, wherein an improved, short-throw locking mechanism is provided allowing the user to quickly and easily lock the inner pole section relative to the outer pole section at any desired degree of extension. The invention also provides a unique shock-absorbing capacity which eliminates the possibility of pole damage in the event of unrestrained fall of the inner pole section. Finally, an improved fixture connection is provided in the form of a locking member adjacent the upper end of the extension pole permitting the user to firmly lock in place any desired operating fixture against inadvertent twist-off.

2. Description of the Prior Art

Extension poles have long been available for use by painters, other workmen or homeowners. Broadly speaking, such extension poles include one or more sections allowing the pole to assume varying lengths required for a given job. Moreover, a number of different operating tools have been used with these extension poles, for example light bulb changers or paint rollers.

Despite the widespread availability of conventional extension poles, a number of unresolved problems remain. For example, many such poles have a threaded shank or stub adjacent the outer end thereof for receiving a fixture. In the case of a light bulb changer for example the changer has a threaded shank which is secured to the stub. In use, however, during rotation of the extension pole while installing or uninstalling a light bulb, the fixture itself may begin to rotate and inadvertently twist entirely off of the connection stub.

Further, it often happens that through neglect or accident the inner pole section falls in an unrestrained fashion with considerable force against the bottom or base of the outer pole section. This can cause damage to the pole and even render it inoperative.

Finally, some prior poles have twist-type locking mechanisms serving to lock the inner pole section relative to the outer section at desired, relatively shifted locations. However, these prior mechanisms often require twisting of a collar or chuck through a significant degree of rotation in order to effect locking or unlocking. This can be an issue, particularly when the pole is extended and the operator must carefully manipulate the pole in order to avoid hitting nearby objects.

One prior pole assembly has a locking mechanism made up of three circumferentially spaced apart, axially extending locking fingers with a surrounding collar equipped with corresponding cam projections. In order to lock the pole, the operator grasps the collar and rotates it so as to inwardly deflect the fingers against the inner pole section.

There is accordingly a need in the art for improved extension poles which overcome the aforementioned problems and provide smooth, easy pole operation.

SUMMARY OF THE INVENTION

The present invention overcomes and provides an extension pole including a pair of telescopically interfitted inner and outer pole sections in the form of an outer section having a base and an inner pole section reciprocal within and relative to the outer section. In order to afford a high degree of shock-absorbing capacity, a resilient shock-absorbing component is located within the outer pole section proximal to the base thereof, in an orientation for engaging the inner pole section as it is lowered or dropped against the base. Preferably, the shock-absorbing component is in the form of a resilient synthetic resin pad which is directly engaged by the end of the inner pole section.

In order to provide a more secure connection of working fixtures to the outer end of an extension pole, the present invention provides an outwardly projecting tool supporting and securing element preferably in the form of a threaded shaft. Further, a threadably mounted locking member is disposed about the element, with the member operable for engaging the end of a supported fixture. Preferably, the locking member is in the nature of a jamb nut or collar which forcibly engages the inner end of the fixture, preventing inadvertent twist-off thereof.

Finally, the extension poles of the invention have improved locking mechanism characterized by short-throw operation, through less than 45° of arc. The preferred locking mechanism makes use of specially configured locking segments formed with camming regions; a rotatable chuck cam is mounted adjacent the locking segments so that upon rotation of the chuck the segments are displaced into tight frictional locking engagement with the inner pole section.

DETAILED DESCRIPTION OF THE PREFERRED EMBODIMENT

Figures 1, 2, 3:
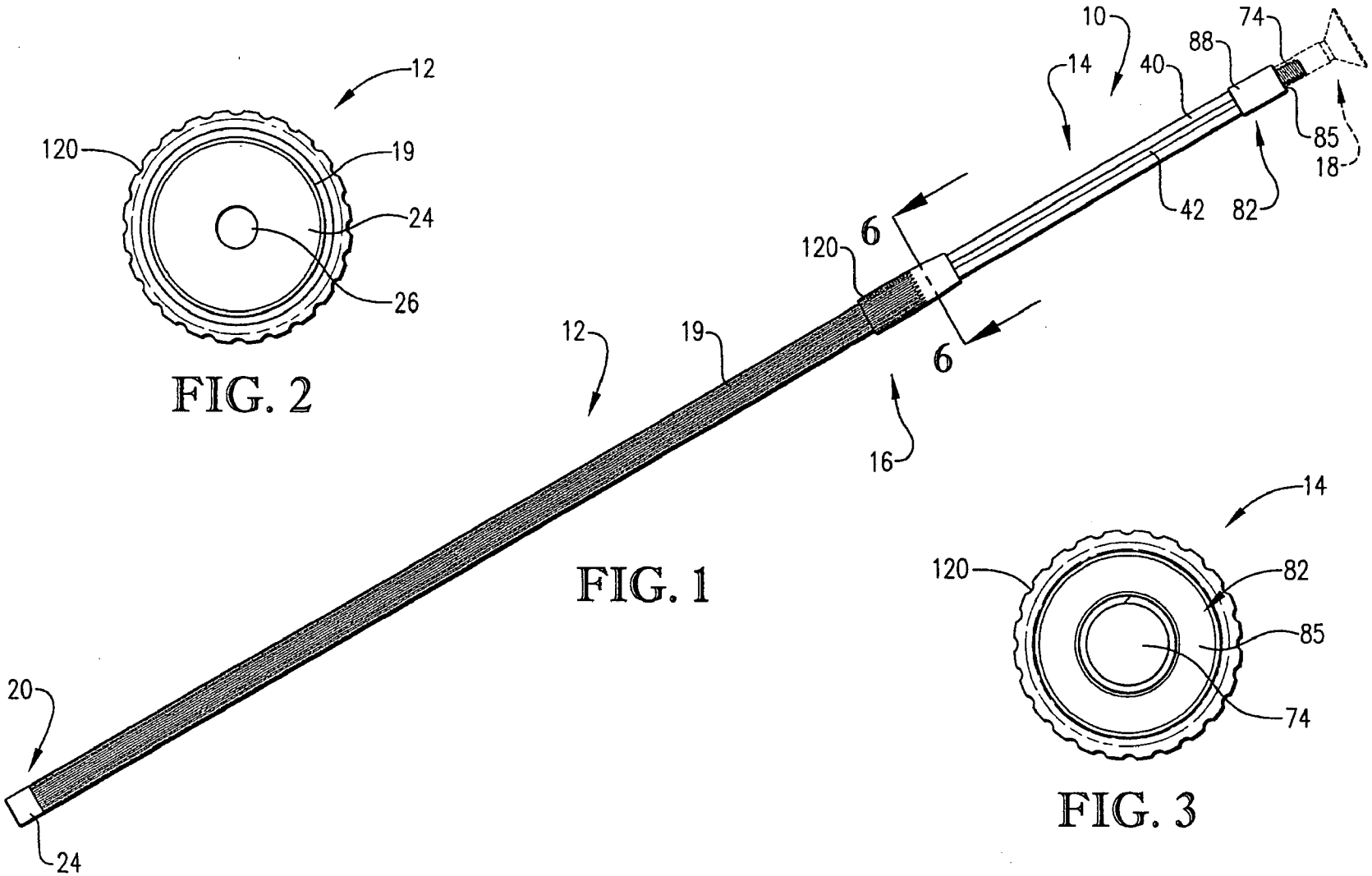
FIG. 1 is an elevational view of a preferred extension pole in accordance with the invention, illustrated with a bulb changer fixture on the tool, the changer being depicted in phantom.
FIG. 2 is an end view of the pole illustrated in FIG. 1 viewed from the bottom end thereof remote from the fixture.
FIG. 3 is an end view of the pole of FIG. 1, viewing the end opposite that of FIG. 2, with the fixture omitted.

Turning now to the drawings, FIG. 1 illustrates an extension pole 10 in accordance with the invention. The pole 10 broadly includes an outer, extruded aluminum, fluted tubular pole section 12, an inner pole section 14 telescopically received within the section 12, and a locking mechanism 16 operably coupling the pole sections 12 and 14 and permitting locking of the section 14 at any one of a number of positions relative to section 12. In FIG. 1, a light bulb changer 18 is shown in phantom, mounted on the end of section 14. It will be understood however that the overall pole 10 is capable of supporting a number of different fixtures well known to those skilled in the art.

In more detail, the outer pole section 12 is in the form of an elongated tubular body 19 having a base 20 and upper open end 22, the latter including a slot 23. The base (see FIG. 8) includes an end plug 24 having a central bore 26 and a reduced diameter upper end 28 adapted to fit within the confines of tubular body 19. In addition, the end 28 is configured to present a groove 30 adapted to receive a resilient O-ring 32. The overall base 20 further comprises a washer 34 which abuts plug 24 and compresses O-ring 32 in order to maintain the plug 24 within body 19. To this end, a screw 36 is positioned within bore 26 and is threaded into a complemental bore forming a part of washer 32. It will thus be seen that tightening of screw 36 serves to compress O-ring 32 between washer 34 and groove 30. This effects a secure connection of the base 20 with body 19.

Finally, the base 20 has a resilient, shock-absorbing foam pad 38 which engages the face of washer 34 remote from plug 24. The pad 38 serves an important purpose to be described in detail below, namely to absorb impact loads incident to unrestrained retraction of inner pole section 14.

Inner pole section 14 is in the form of an elongated, extruded aluminum body 40 adapted to fit within and telescope relative to the body 19. The body 40 includes an elongated, axially extending groove 42 extending the full length thereof, with the groove having a pair of connection openings 44 adjacent the upper end thereof and a slot 46 adjacent the lower end thereof.

Figures 7A, 7B, 7C:
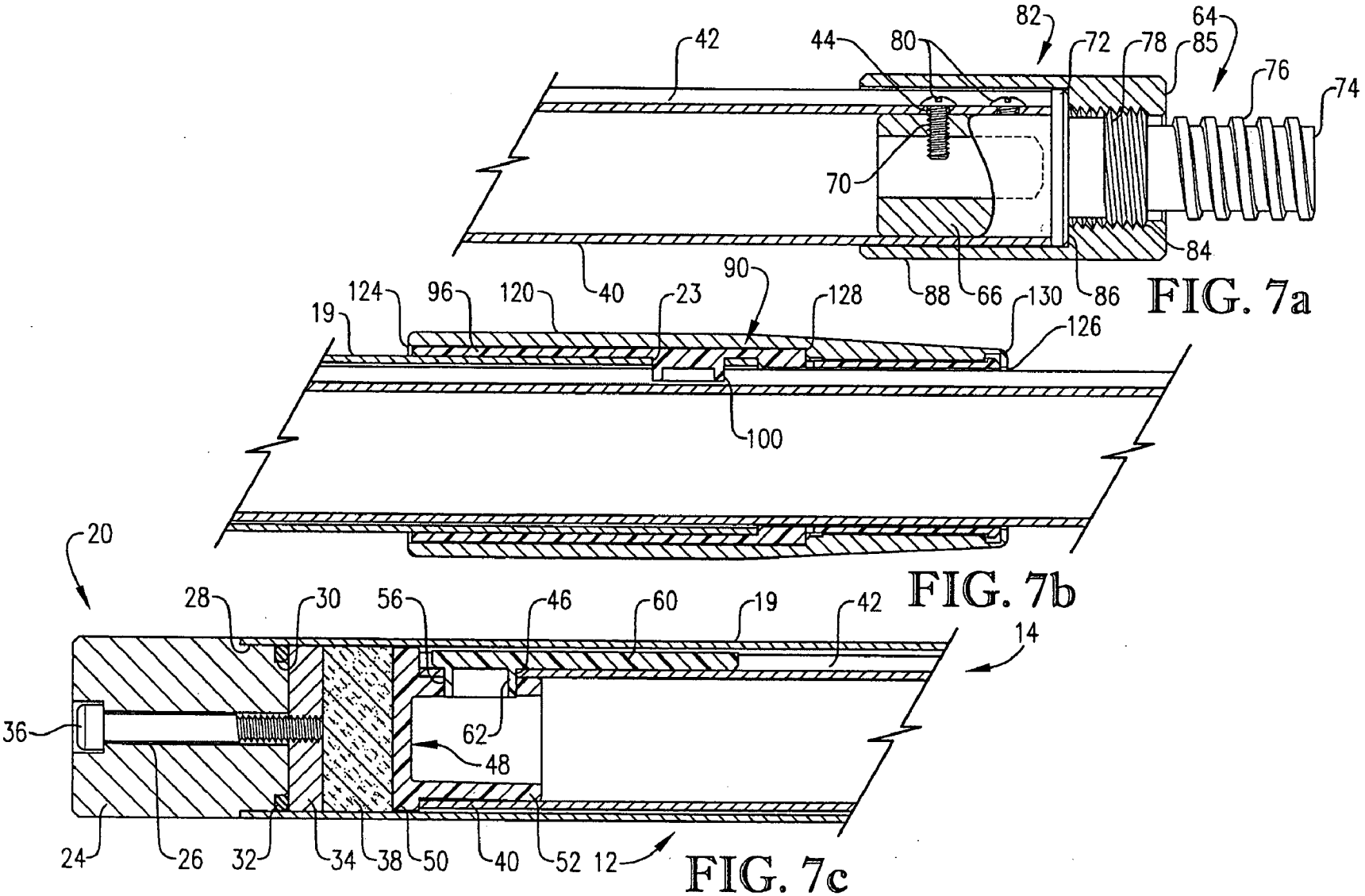
FIG. 7*a* is a fragmentary view in partial vertical section and with parts broken away, illustrating in detail the construction of the fixture-supporting end of the pole.
FIG. 7*b* is a fragmentary view in vertical section illustrating the components of the preferred collet cam locking mechanism.
FIG. 7*c* is a fragmentary view in partial vertical section illustrating in detail the construction of the base end of the pole.

The lower end of body 40 has a guide plug 48 with a circular base 50 and an upstanding tubular segment 52 having a flat face 54 and slot 56. The segment 52 is designed to fit within the inner end of body 40 as best seen in FIG. 7*c*. The guide plug 48 is retained in this position by means of an elongated, synthetic resin retainer 58 including a web 60 and boss 62. The web 60 fits within groove 42 of body 40, whereas boss 62 extends through the mating slots 46, 56, thereby locking the guide plug in place.

The upper end of body 40 is equipped with a fixture mount 64 having a tubular connector stub 66 presenting a flat face 68 and a pair of threaded bores 70. The mount 64 also has a radially enlarged wall 72 and outwardly extending mounting shaft 74 having coarse threading 76. Also, the shaft 74 has fine threading 78 (see FIG. 7*a*) between wall 72 and threading 76. The mount 64 is secured to the upper end of body 40 by means of screws 80 which extend through the groove openings 44 and are threaded into bores 70.

An annular locking member or sleeve 82 is also secured to the upper end of body 40. The sleeve 82 includes an upper threaded section 84 presenting an abutment face 85. The threaded section 84 mates with threading 78. The sleeve 82 also includes an internal annular shoulder 86 and skirt 88. The sleeve 82 is threaded onto the fine threading 78 of shaft 74, and shoulder 86 bottoms out against wall 72. It will be observed that the threading 84 permits sleeve 82 to be threaded outwardly along the length of shaft 74. The importance of this feature will be made clear hereinafter.

Figures 4, 5A, 5B, 6:
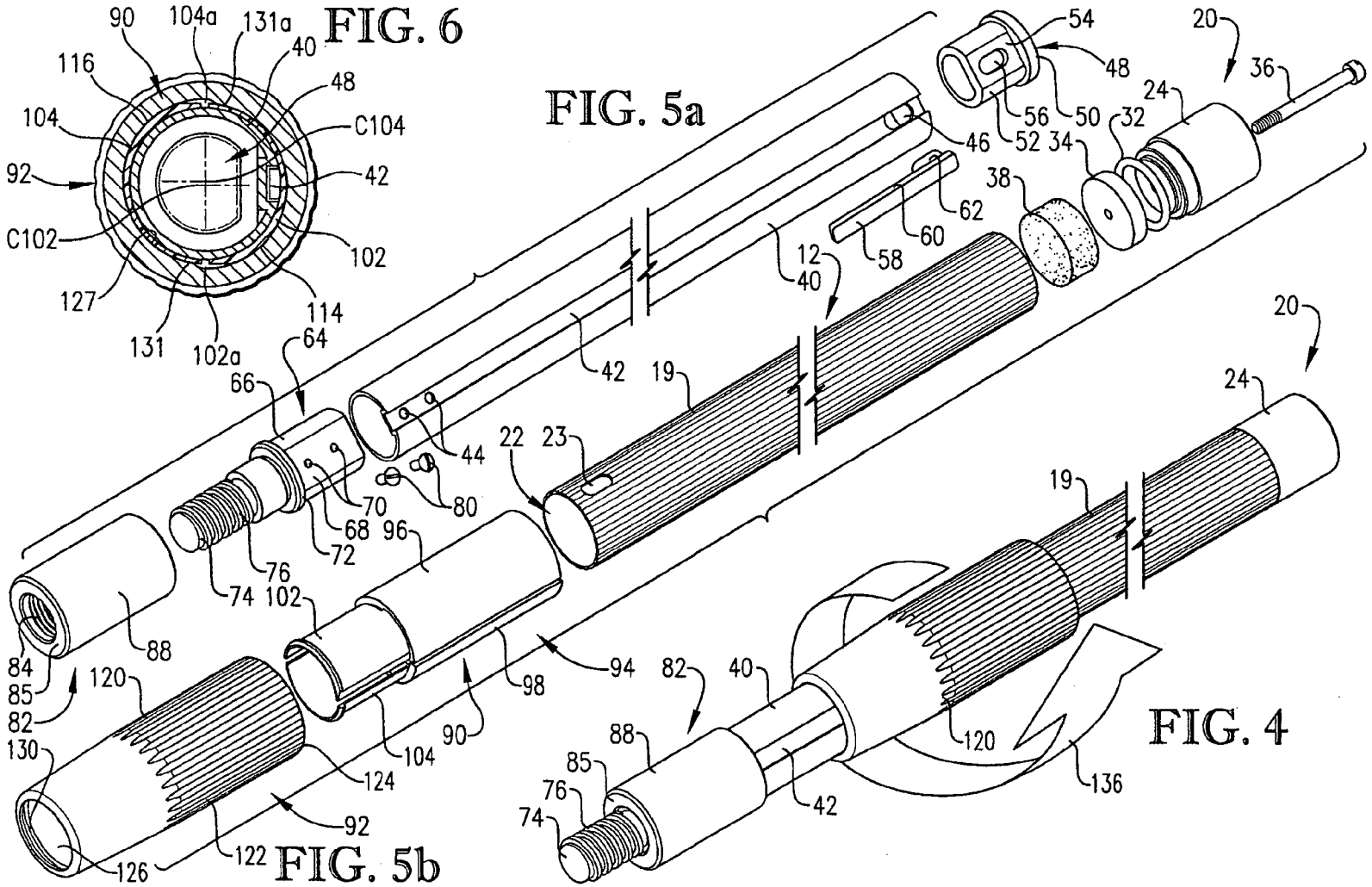
FIG. 4 is a fragmentary isometric view of the preferred pole, depicting the twist-lock operation thereof.
FIGS. 5*a* and 5*b* are respectively exploded views of the inner, slotted channel pole and the exterior, fluted stationary pole.
FIG. 6 is a sectional view taken along line 6—6 of FIG. 1 and illustrating in detail the construction of the preferred collet cam locking mechanism.
Figure 9:
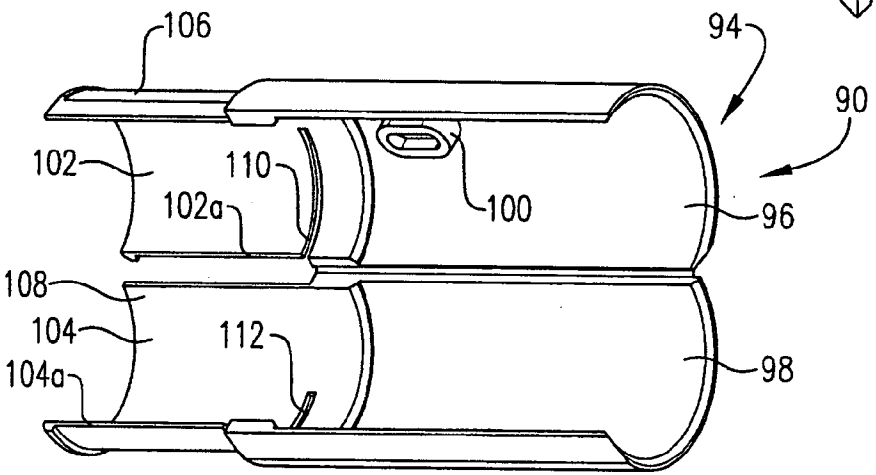
FIG. 9 is an isometric view of the preferred collet cam, shown in its open position prior to attachment to the inner channel pole.

The locking mechanism 16 includes a resilient synthetic resin tubular collet cam 90 and a chuck cam 92 designed to fit over the cam 90. Specifically, the collet cam 90 has a tubular primary mounting section 94 made up of two hingedly connected half-sections 96 and 98. As best seen in FIGS. 7*b* and 9, the half-section 96 has an inwardly extending boss 100. The overall cam 90 also has a pair of elongated, axially extending, arcuate in cross-section locking segments 102, 104 which extend in an axial direction from the corresponding sections 96, 98. The segments 102, 104 are specially configured and are supported by respective, elongated, axially extending connections portions 106, 108 integral with the associated sections 96, 98. Each segment 102, 104 also has a slot or cut line 110, 112 so that the corresponding segment presents an axially extending, unrestrained outboard margin 102*a*, 104*a*. Additionally, and as best seen in FIG. 6, each of the segments 102, 104 has, along the width thereof between the connection portions 106, 108 and the margins 102*a*, 104*a*, a region of increased thickness 114, 116 which progresses from the connection portions toward the free margins. Thus, the regions 114, 116 present cam surfaces for each of the segments. It will be observed that the inner surfaces of each of the arcuate segments 102, 104 presents a radius of curvature. In order to maximize the camming action of the segments, the centers of the radii of curvature are offset. As shown in FIG. 6, the radius of curvature for the segment 102 has a center at C102, whereas the radius of curvature for the segment 104 has a center at C104. These centers C102 and C104 are slightly offset as depicted.

Figure 10:
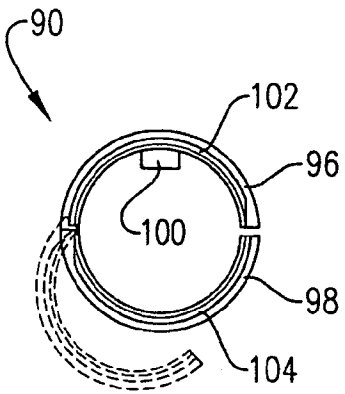
FIG. 10 is an end view of the collet cam depicted in FIG. 9, showing the opened condition of the cam in phantom and the closed position thereof in full lines.

As illustrated in FIGS. 9 and 10, the collet cam 90 is manufactured from resilient synthetic resin material as a single component having the primary connection section 94 and segments 102, 104. For ease of installation, during manufacture an elongated hinge region 118 is provided along the length of the half sections 96, 98, thereby facilitating snap-on connection of the collet cam 90 onto tubular body 19. In particular, this involves folding the opened cam 90 over the upper end of body 19 and insertion of boss 100 into slot 23.

The chuck cam 92 is in the form of a tubular extruded aluminum body 120 having exterior fluting 122, opposed inner and outer open ends 124, 126, and a non-circular camming inner surface 127. The chuck 92 is adapted to be fitted over collet cam 90 and to this end includes an internal annular shoulder 128 which abuts the transition between the half-sections 96, 98 and the segments 102, 104. Additionally, the outer end 126 has an inturned lip 130 which covers the outer end of the segments 102, 104 (see FIG. 7*b*). As shown in FIG. 6, the inner surface 127 of chuck cam 92 engageable with cam 90 has a pair of camming regions 131, 131*a*. These regions interact with the regions 114, 116 of segment 102, 104 during rotation of chuck cam 92.

Figure 8:
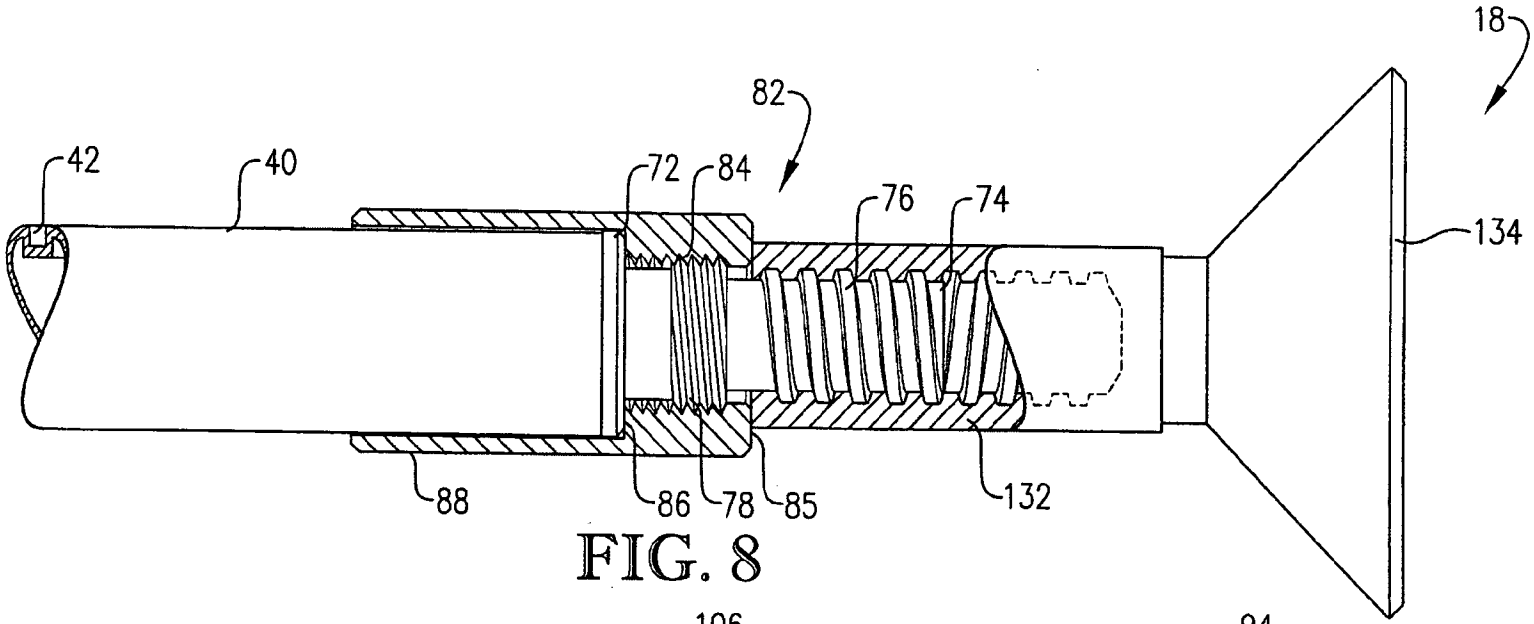
FIG. 8 is a fragmentary view in partial vertical section and partially in phantom, showing a fixture secured to the end of the pole, and with the locking sleeve of the pole in abutting, locking engagement with the fixture.

During use of pole 10, a fixture such as light bulb changer 18 is first mounted on shaft 74. Referring to FIG. 8, it will be seen that the exemplary changer 18 has an internally threaded shank 132 as well as a resilient, conical light bulb holder 134. The shank 132 is first threaded onto shaft 74. Thereupon, the sleeve 82 is rotated until face 85 thereof comes into direct abutting engagement with the inner annular face of shank 132. This serves to lock the fixture 18 in place on the shaft 74, to prevent inadvertent loosening or detachment thereof during rotation of the pole 10.

In the next step, the inner pole section 14 is extended relative to outer section 12. This involves first loosening the locking mechanism 16 by rotation of chuck cam 92 in counter clockwise direction as viewed in FIG. 4 and depicted by arrow 136. The section 14 may then be extended to any desired extent, guided by boss 100 seated within groove 42 and ultimately limited by the abutment of base 50 of guide plug 48 against boss 100, thus defining the maximum degree of extension of the section 14. At any desired extension of the section 14, the latter may be locked in place relative to outer section 12. This involves merely a short twisting or rotational movement of chuck cam 92 in a direction opposite that shown in FIG. 4 at arrow 136. When this occurs, the regions 131, 131*a* of the inner surface 127 of the chuck cam 92 rides against and engages the cam regions 114, 116 of the locking segments 102, 104. As a consequence, the locking segments come into firm, frictional locking engagement with the adjacent surfaces of body 19 of the inner pole section 12, preventing any further movement of the inner section 14 relative to outer section 12. A feature of the invention is that this locking/unlocking rotation of chuck 92 occurs through a relatively short arc, less than about 45°.

In the event that the chuck 92 is loosened either inadvertently or intentionally, the inner pole section 14 can freely fall under the influence of gravity toward base 20 of pole section 12. In order to prevent any damage to the inner pole section or the base, the pad 38 comes into play. This pad is capable of safely absorbing any shock forces incident to unrestrained dropping of the inner pole section 14, thereby enhancing the structural integrity of pole 10. While in the preferred embodiment a resilient synthetic resin plug is used, it will be understood that other types of shock absorbing components, for example springs, could be used in lieu of the plug 38.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

The invention claimed is:

1. An extension pole, comprising:

an elongated, tubular outer pole section;

an elongated inner pole section telescopically received within said outer pole section and shiftable relative thereto; and a locking mechanism for locking said inner pole section at any one of the number of different positions relative to said outer pole section, said locking mechanism including an elongated, tubular collet cam disposed about and operatively coupled with said outer pole section and having at least a pair of body sections and a corresponding pair of axially projecting, resilient locking segments, each of said segments having an elongated, axially extending connection portion and having an unrestrained, axially extending margin remote from said connection portion, each of said segment margins being radially displaceable relative to the corresponding connection portion, each of said segment margins being separated from the body section by a circumferentially extending slot so that the segment margins are attached to the respective body section by the connection portion and cantilevered from the connection portion in a circumferential direction; and a chuck shiftably secured to said outer pole section and adjacent said collet cam, said chuck upon shifting thereof operable to inwardly displace said segment margins in order to lock said inner pole section relative to said outer pole section.

2. The pole of claim 1, each of said segments having, along the width thereof between said connection portion and said margin, a region of increased thickness, said chuck rotationally mounted to said outer pole section and having surfaces adjacent said segments for engaging said regions and camming the segments into frictional locking engagement with said inner pole section.

3. The pole of claim 1, each of said segments being arcuate in cross section and presenting an inner surface having a radius of curvature with a central axis, the central axes of said inner surfaces being offset from one another.

4. The pole of claim 1, each of said segments having an outermost arcuate edge, there being a cut line in each segment axially spaced from the corresponding edge and generally parallel thereto.

5. The pole of claim 1, said cam including an inwardly extending stop extending through said outer pole section.

6. The pole of claim 1, said chuck and collet cam cooperatively configured for locking said inner pole section relative to said outer pole section by rotation of said chuck through an angle of less than about 45°.

7. An extension pole presenting a longitudinal axis, said extension pole comprising:

an elongated, tubular outer pole section;

an elongated inner pole section telescopically received within said outer pole section and shiftable relative thereto; and a locking mechanism for locking said inner pole section at any one of the number of different positions relative to said outer pole section, said locking mechanism including an elongated, tubular collet cam disposed about and operatively coupled with said outer pole section and having a pair of resilient locking segments, each of said segments having a region with an outwardly-facing surface, said outwardly-facing surface presenting a radial outer dimension that progressively increases in a circumferential direction defined within a perpendicular cross-section relative to the axis; and a chuck shiftably secured to said outer pole section and adjacent said tubular collet cam, said chuck upon shifting thereof operable to displace said segments in order to lock said inner pole section relative to said outer pole section, said chuck rotationally mounted to said outer pole section and having inwardly-facing surfaces, each of said inwardly-facing surfaces presenting a radial inner dimension that progressively increases in the circumferential direction, said inwardly-facing surfaces being spaced adjacent to said segments for engaging said outwardly-facing surfaces and camming the segments into frictional locking engagement with said inner pole section as the chuck is rotated relative to the collet cam.

8. The pole of claim 7, each of said segments being arcuate in cross section and presenting an inner surface having a radius of curvature with a central axis, the central axes of said inner surfaces being offset from one another.

9. The pole of claim 7, each of said segments having an outermost arcuate edge, there being a cut line in each segment axially spaced from the corresponding edge and generally parallel thereto, whereby each of the segments is supported by an elongated, axially extending connection portion, and each segment having an unrestrained, axially extending margin remote from said connection portion.

10. The pole of claim 7, said cam including an inwardly extending stop extending through said outer pole section.

11. The pole of claim 7, said chuck and collet cam cooperatively configured for locking said inner pole section relative to said outer pole section by rotation of said chuck through an angle of less than about 45°.

12. The pole of claim 7, one of said elongated pole sections having one end thereof adapted for supporting any one of a number of fixtures, said one end including an outwardly projecting tool supporting and securing element, said element including first and second threaded portions, and a threadably mounted locking member disposed about the first threaded portion, said second threaded portion operable for threadably receiving each of the fixtures, said member operable for engaging an end of a respective one of the fixtures threadably received on the second threaded portion, said threaded portions having thread pitches different from each other.

13. The pole of claim 7, said elongated, tubular collet cam having at least a pair of body sections, each of said segments having an elongated, axially extending connection portion and having an unrestrained, axially extending margin remote from said connection portion, each of said segment margins being radially displaceable relative to the corresponding connection portion, each of said segment margins being attached to the respective body section by the connection portion and cantilevered from the connection portion in a circumferential direction.

* * * * *